US006297583B1

(12) United States Patent
Kohne et al.

(10) Patent No.: US 6,297,583 B1
(45) Date of Patent: Oct. 2, 2001

(54) GAS DISCHARGE LAMP ASSEMBLY WITH IMPROVED R.F. SHIELDING

(75) Inventors: Robert L. Kohne, Noblesville; Jack D. Bodem, Jr., Kokomo, both of IN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/168,476

(22) Filed: Oct. 8, 1998

(51) Int. Cl.[7] ..... H01J 1/50; H01J 23/10; H01J 29/76

(52) U.S. Cl. ..... 313/161; 131/313; 131/607; 131/634; 315/248; 315/344

(58) Field of Search ..... 313/160, 161, 313/607, 313, 242, 248, 153–159, 613, 283, 634; 315/248, 344, 39, 57, 85, 70; 445/23

(56) References Cited

U.S. PATENT DOCUMENTS

| | | | | |
|---|---|---|---|---|
| 3,767,957 | | 10/1973 | Ott . | |
| 3,824,515 | * | 7/1974 | Holman | 335/213 |
| 4,152,745 | * | 5/1979 | Eul | 361/146 |
| 4,206,387 | | 6/1980 | Kramer . | |
| 4,240,010 | | 12/1980 | Buhrer . | |
| 4,254,363 | | 3/1981 | Walsh . | |
| 4,328,446 | | 5/1982 | Fallier, Jr. . | |
| 4,427,925 | | 1/1984 | Proud . | |
| 4,645,967 | | 2/1987 | Bouman . | |
| 4,767,969 | | 8/1988 | Green . | |
| 4,940,923 | | 7/1990 | Kroontje . | |
| 5,006,763 | | 4/1991 | Anderson . | |
| 5,027,041 | | 6/1991 | Godyak . | |
| 5,065,075 | | 11/1991 | Greb . | |
| 5,124,895 | | 6/1992 | Segoshi . | |
| 5,287,258 | | 2/1994 | Remus . | |
| 5,397,966 | | 3/1995 | Vrionis . | |
| 5,539,283 | | 7/1996 | Piejak . | |
| 5,677,596 | | 10/1997 | Mueller . | |
| 5,710,485 | | 1/1998 | Schmitt . | |

* cited by examiner

*Primary Examiner*—Nimeshkumar D. Patel
*Assistant Examiner*—Matthew John Gerike
(74) *Attorney, Agent, or Firm*—Reising, Ethington, Barnes, Kisselle, Learman & McCulloch, P.C.

(57) ABSTRACT

An inductively driven gas discharge lamp assembly (40) includes an electrodeless lamp (42), an inductive drive coil (44) disposed about the lamp, and a shield (10) disposed over an end portion (50) of the lamp. The shield (10) has a number of turns (12) of electrically conductive material, such as wire, with each of the turns being disposed generally coaxially about the central, longitudinal axis (20) of the drive coil (44). The turns (12) together form a continuous spiral helix and are shorted together via a number of electrical conductors (14) that are angularly disposed about the axis (20). These electrical conductors (14) extend generally perpendicularly to the turns (12) and are connected to the ground node (26) of a d.c. to a.c. inverter circuit 46 that is used to drive coil 44. This arrangement provides good r.f. electric field and magnetic field shielding and permits the use of relatively few turns (12) at a relatively large spacing of the turns so as to minimize the interference of the shield (10) on the amount of light emitted from the lamp (42). Also disclosed is another embodiment (30) in which the turns (32) each comprise a single loop rather than a continuous spiral helix.

14 Claims, 1 Drawing Sheet

GAS DISCHARGE LAMP ASSEMBLY WITH IMPROVED R.F. SHIELDING

BACKGROUND OF THE INVENTION

1. Technical Field

This invention relates in general to inductively driven electrodeless gas discharge lamps and, in particular, to electromagnetic shielding of radio frequency interference emitted from the drive coils used to energize such lamps.

2. Description of the Related Art

Inductively driven electrodeless gas discharge lamps utilize a solenoidal coil driven with alternating current to produce a plasma discharge within the lamp envelope. Alternating current flow through the coil generates a time-varying magnetic field that impinges upon the ionizable gas fill within the lamp, causing it to produce the plasma discharge. The gas fill can be an inert or other rare earth gas, such as neon, which produces a visible discharge when excited by the magnetic field.

Often, these lamps are driven at radio frequencies resulting in strong magnetic and electric fields that radiate well beyond the lamp envelope. In many applications, these radiated fields can detrimentally effect the operation of nearby circuits and sensors. For example, when used in automotive applications, the drive coils used to energize these lamps could detrimentally influence such things as engine sensors and the vehicle's electronic compass. Accordingly, it is well known to shield the electromagnetic radiation emanating from the drive coil. Although electric and magnetic field shielding is most effectively accomplished with a grounded, electrically conductive, ferromagnetic enclosure, such an arrangement is not practical since it would also shield the light transmitted by the lamp, making the entire assembly useless for its intended purpose.

Consequently, shielding is typically accomplished using a conductive screen or wire mesh that extends over all or a portion of the lamp envelope. See, for example, U.S. Pat. No. 5,397,966 to Vrionis et al. One problem with the use of a wire mesh for shielding purposes is that it can cause a significant reduction in the light output from the lamp due to the large total area covered by the wire making up the mesh. Vrionis et al. also disclose a shield made up of a plurality of electrically conductive fingers that extend generally in the direction of the axis of the induction coil. This arrangement of conductive fingers helps reduce any detrimental effect that the shield has on the efficiency of the lamp operation; however, it is believed that it also results in a correspondingly reduced effectiveness of the magnetic shielding effect.

SUMMARY OF THE INVENTION

The invention provides an electrodeless gas discharge lamp assembly which provides good electric and magnetic field shielding while minimizing its impact on the light output of the lamp. The lamp assembly includes a gas discharge lamp having a sealed envelope containing an ionizable gas fill, an inductive drive coil disposed about the lamp envelope, and a shield disposed over an end portion of the lamp envelope. The shield has a number of turns of electrically conductive material, such as wire, with each of the turns being disposed generally coaxially about the central, longitudinal axis of the drive coil. The turns are shorted together via a number of electrical conductors that are angularly disposed about the axis. These electrical conductors extend generally perpendicularly to the turns, either axially or radially, or both, relative to the longitudinal axis about which they are disposed. When connected in circuit, the electrical conductors are grounded. This arrangement provides good r.f. electric field and magnetic field shielding and permits the use of relatively few turns at a relatively large spacing of the turns so as to minimize the interference of the shield on the amount of light emitted from the lamp.

In one embodiment, the turns of the shield together comprise a continuous electrical path extending in a spiral helix about the end portion of the lamp. Each turn is shorted to each of the other turns at ninety degree intervals about their central, longitudinal axis. In another embodiment, each turn comprises a single loop, with some or all of the loops being shorted together via the electrical conductors.

BRIEF DESCRIPTION OF THE DRAWINGS

A preferred exemplary embodiment of the present invention will hereinafter be described in conjunction with the appended drawings, wherein like designations denote like elements, and.

DESCRIPTION OF THE PREFERRED EMBODIMENT

Figure 1:
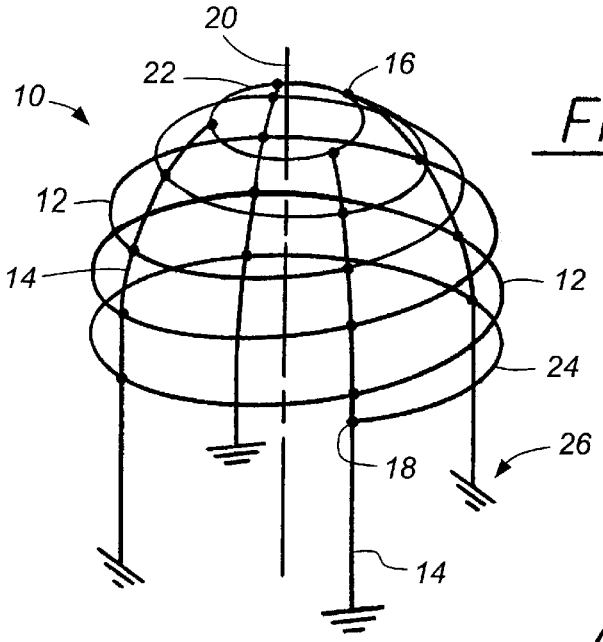
FIG. 1 is a perspective view of a preferred embodiment of a shield of the present invention.

As shown in FIG. 1, an r.f. shield 10 of the present invention includes a number of turns 12 of an electrically conductive material, such as metal wire, with each turn 12 being electrically shorted to its adjacent turns via a number of perpendicularly extending conductors 14. Turns 12 together comprise a coil that defines continuous electrical path extending as a spiral helix from a first end 16 to a second end 18. Each turn 12 comprises an approximately 360° loop that is coaxially disposed about a longitudinal axis 20 of shield 10. These turns are shorted to each other by electrical conductors 14 at ninety degree intervals about axis 20. Conductors 14 can be formed of the same electrically conductive material as turns 12 (e.g., metal wire). Each conductor 14 extends perpendicularly across each of the turns 12 from a first turn 22 to a last turn 24 where the conductors 14 are connected in circuit to a ground node 26.

Preferably, each of the turns 12 are shorted together via the conductors 14, although it will be understood that one or more turns could be left disconnected from conductors 14. Alternatively, each of the conductors 14 can be electrically connected to some, but not all of the turns 12 such that each turn 12 is grounded via at least one of the conductors 14. Although four such conductors 14 are shown, it will be appreciated that more or less conductors 14 could be used, as desired for a particular application. Additionally, the conductors 14 need only be generally perpendicular to turns 12; that is, they can either run perpendicular to turns 12, as shown, or can wrap somewhat helically about longitudinal axis 20. Other such variations will become apparent to those skilled in the art.

Figure 2:
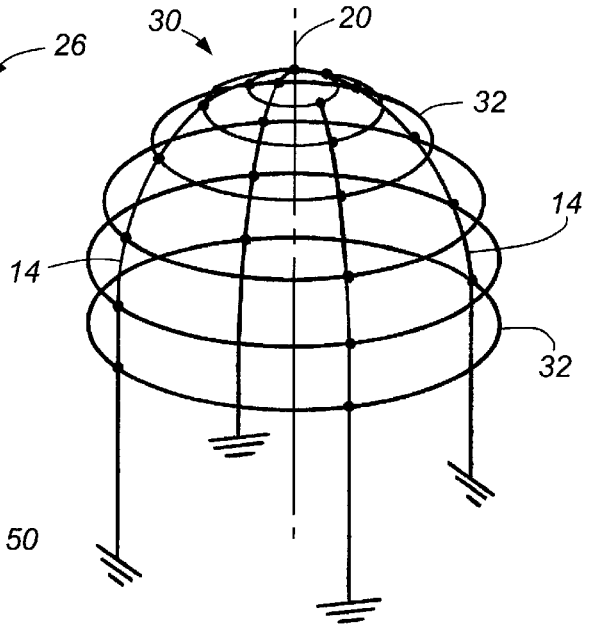
FIG. 2 is a perspective view of a second embodiment of a shield of the invention.

Referring now to FIG. 2, there is shown a second embodiment of an r.f. shield of the invention, designated generally as 30. Shield 30 can be exactly the same as shield 10 of FIG. 1, except that it includes a number of turns 32, each of which is an individual loop rather than one turn of a continuous spiral helix. The turns 32 are coaxially disposed about longitudinal axis 20 and are only connected to one another by the electrical conductors 14. The various design considerations and variations discussed above and below in connection with FIGS. 1 and 3 apply equally to shield 30 of FIG. 2.

Figure 3:
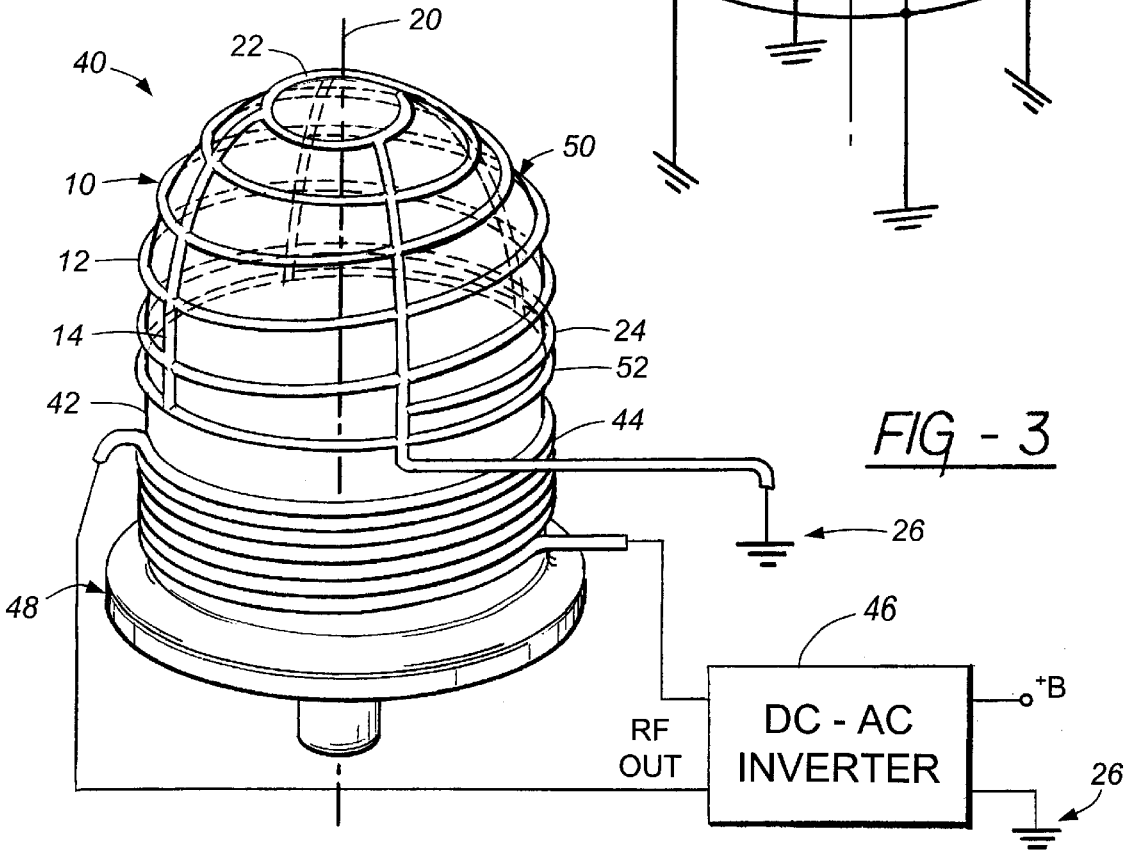
FIG. 3 is a perspective view of a shield as in FIG. 1 used as a part of an inductively driven lamp assembly.

FIG. 3 depicts shield 10 as it may be implemented as a part of an inductively driven gas discharge lamp assembly 40. In addition to shield 10, lamp assembly 40 includes an electrodeless lamp 42, an inductive drive coil 44, and a d.c. to a.c. inverter circuit 46. Lamp 42 can be a conventional gas discharge lamp having an ionizable gas fill enclosed within a sealed envelope. Neon or other rare gases that produce a plasma discharge when subjected to high frequency magnetic fields can be used. Inductive drive coil 44 is disposed about lamp 42 such that both it and shield 10 are coaxially disposed about longitudinal axis 20. Coil 44 can be wound using insulated copper wire and can be wound directly on lamp 42 or on a separate bobbin (not shown). Coil 44 is driven with an r.f. alternating current to thereby produce a time-varying magnetic field that produces the plasma discharge within lamp 42. The r.f. current is generated by inverter circuit 46 which can be a self-oscillating circuit that operates off a d.c. supply, such as a battery voltage (labelled $^{+}$B). Suitable inverter circuits are well known to those skilled in the art. The electric field shielding provided by r.f. shield 10 is realized by connection of conductors 14 to the input ground 26. Of course, shield 10 could also be connected to another low impedance node, such as $^{+}$B.

As shown in FIG. 3, lamp 42 includes a base portion 48 and an end portion 50 which is generally hemispherical in shape. Shield 10 has a complementary conformation that provides a close fit over end portion 50. Electrical conductors 14 therefore extend arcuately from the first turn 22 (where they extend in a generally radial direction) to the last turn 24 (where they extend in a generally axial direction). Rather than using wire for turns 12 and conductors 14, these electrical paths could be formed as electrically conductive traces on the surface of lamp 42. Alternatively, these electrical paths could be formed as a part of a lens or other light transmissive cover than is placed over the end portion 50 of lamp 42. In any of these variations shield 10 need not be in contact lamp 42, but can instead have a larger overall size such that it extends over lamp 42 without coming into contact with it. Moreover, if desired for a particular application, shield 10 can extend further down towards the base 48 of lamp 42 such that it surrounds all or a part of drive coil 44.

Rather than separately connecting each of the electrical conductors 14 to the ground node 26, all but one of the conductors 14 can terminate at a lower loop 52 with that one conductor 14 then being connected to ground node 26. Similarly, rather than using lower loop 52, all but one of the conductors 14 can terminate on the last turn 24 of shield 10 with that one conductor then being connected to ground node 26. Furthermore, where one of the ends of drive coil 44 is connected to a low impedance node, such as ground, the electrical conductors 14 can be connected directly to that one end of coil 44 rather than separately wired to inverter circuit 46.

As will be appreciated by those skilled in the art, the spacing of the individual turns depicted in FIG. 3 is exemplary only and the actual spacing for any particular lighting application can be selected based upon the relative need for shielding versus total light output. In this regard, the shield can be made from wire or other conductors that are much thinner than that used for drive coil 44.

R.F. shield 10 results in much less surface area of the lamp envelope being covered than occurs when using a mesh or screen for shielding. Also, since the turns 12 are oriented coaxially along the same axis as drive coil 44, shield 10 provides better magnetic shielding than the conductive finger arrangement disclosed in the above-noted U.S. Pat. No. 5,397,966 to Vrionis et al.

It will thus be apparent that there has been provided in accordance with the present invention a shielded gas discharge lamp assembly which achieves the aims and advantages specified herein. It will of course be understood that the foregoing description is of a preferred exemplary embodiment of the invention and that the invention is not limited to the specific embodiment shown. Various changes and modifications will become apparent to those skilled in the art. For example, when used with a lamp having a relatively planar light emitting surface, the shield can comprise concentric turns with radially-extending electrical conductors. All such variations and modifications are intended to come within the scope of the appended claims.

We claim:

1. An inductively driven gas discharge lamp assembly, comprising:

an electrodeless gas discharge lamp having a sealed envelope containing an ionizable gas fill, said envelope having at least one light transmissive end portion;

an inductive drive coil disposed about said envelope, said drive coil having a central, longitudinal axis that extends through said lamp envelope, whereby an alternating current driven through said drive coil produces a time-varying magnetic field that impinges upon said gas fill;

characterized in that:

the lamp assembly further comprises a shield disposed over said end portion of said lamp envelope, said shield having a number of turns of electrically conductive material with each of said turns being disposed generally coaxially about said longitudinal axis in spaced relation from the others of said turns, wherein at least some of said turns are shorted together by a number of electrical conductors that are angularly disposed about said axis and that extend generally perpendicularly to said turns.

2. A lamp assembly as defined in claim 1, wherein said turns of said electrically conductive material comprises a continuous electrical path extending in a spiral helix about said end portion.

3. A lamp assembly as defined in claim 2, wherein said electrically conductive material and said electrical conductors comprise metal wire.

4. A lamp assembly as defined in claim 1, wherein each of said turns of said shield comprises a single loop with at least some of said loops being shorted together via said electrical conductors.

5. A lamp assembly as defined in claim 4, wherein said electrically conductive material and said electrical conductors comprise metal wire.

6. A lamp assembly as defined in claim 1, wherein said shield is in contact with said lamp envelope.

7. A lamp assembly as defined in claim 1, wherein said drive coil comprises a number of turns of insulated wire.

8. A lamp assembly as defined in claim 7, wherein said insulated wire is wound directly on said lamp envelope.

9. A lamp assembly as defined in claim 1, wherein each of said turns of said shield are shorted together via said electrical conductors.

10. A lamp assembly as defined in claim 1, wherein each of said electrical conductors intersects at least some of said turns of said shield.

11. A lamp assembly as defined in claim 1, wherein each of said electrical conductors cross and electrically connect to at least some of said turns of said shield.

12. A lamp assembly as defined in claim 1, wherein said shield and said end portion of said lamp are generally hemispherical and wherein each of said electrical conductors extend arcuately from a first, smaller diameter turn to a last, larger diameter turn.

13. A lamp assembly as defined in claim 12, wherein said conductors extend radially proximate said first turn and extend axially proximate said last turn.

14. A lamp assembly as defined in claim 1, further comprising a d.c. to a.c. inverter circuit for providing operating power to said drive coil, said inverter circuit having at least two inputs with one of said inputs being a ground node, wherein said shield is electrically coupled to said ground node.

* * * * *